US006860274B2

(12) United States Patent
Matsufuji et al.

(10) Patent No.: US 6,860,274 B2
(45) Date of Patent: Mar. 1, 2005

(54) LOW FIRE-SPREADING CIGARETTE

(75) Inventors: Takaaki Matsufuji, Yokohama (JP); Takeo Tsutsumi, Yokohama (JP); Keigo Miura, Yokohama (JP)

(73) Assignee: Japan Tobacco Inc., Tokyo (JP)

( * ) Notice: Subject to any disclaimer, the term of this patent is extended or adjusted under 35 U.S.C. 154(b) by 0 days.

(21) Appl. No.: 10/618,819

(22) Filed: Jul. 15, 2003

(65) Prior Publication Data

US 2004/0011369 A1 Jan. 22, 2004

Related U.S. Application Data

(63) Continuation of application No. PCT/JP02/00046, filed on Jan. 9, 2002.

(30) Foreign Application Priority Data

Jan. 15, 2001 (JP) ..... 2001-006762

(51) Int. Cl.[7] ..... A24D 1/02
(52) U.S. Cl. ..... 131/349; 131/365; 131/360
(58) Field of Search ..... 131/349, 365, 131/360; 162/139

(56) References Cited

U.S. PATENT DOCUMENTS 4,998,543 A * 3/1991 Goodman et al. ..... 131/365
5,203,355 A 4/1993 Clearman et al.
5,327,915 A 7/1994 Porenski et al.
5,921,249 A 7/1999 Hampl, Jr.

FOREIGN PATENT DOCUMENTS

| | | | |
|---|---|---|---|
| JP | 54-151198 | A | 11/1979 |
| JP | 56-144081 | A | 11/1981 |
| JP | 60-59199 | A | 4/1985 |
| JP | 63-85200 | A | 4/1988 |
| JP | 7-300795 | A | 11/1995 |
| JP | 2572488 | B2 | 10/1996 |

* cited by examiner

*Primary Examiner*—Dionne A. Walls
(74) *Attorney, Agent, or Firm*—Birch, Stewart, Kolasch & Birch, LLP

(57) ABSTRACT

A low fire-spreading cigarette has a tobacco section including a columnar tobacco filler material, an inside wrapper paper sheer wrapping the outer circumferential surface of the columnar tobacco filler material and an outside wrapper paper sheet wrapping the outer circumferential surface of the inside wrapper paper sheet. The heat conductivity of the inside wrapper is 0.5 $W \cdot K^{-1} \cdot m^{-1}$ or more and the heat conductivity of the outside wrapper paper sheet is less than 0.5 $W \cdot K^{-1} \cdot m^{-1}$.

18 Claims, No Drawings

LOW FIRE-SPREADING CIGARETTE

This application is a Continuation of copending PCT International Application No. PCT/JP02/00046 filed on Jan. 9, 2002, which was published in Japanese and which designated the United States, and on which priority is claimed under 35 U.S.C. § 120, the entire contents of which are hereby incorporated by reference.

CROSS-REFERENCE TO RELATED APPLICATIONS

This is a Continuation Application of PCT Application No. PCT/JP02/00046, filed Jan. 9, 2002, which was not published under PCT Article 21(2) in English.

This application is based upon and claims the benefit of priority from the prior Japanese Patent Application No. 2001-006762, filed Jan. 15, 2001, the entire contents of which are incorporated herein by reference.

BACKGROUND OF THE INVENTION

1. Field of the Invention

The present invention relates to a low fire-spreading cigarette, when lit, a burning part of which does not easily spread fire to surrounding objects, thus preventing a fire that might be caused by accident due to a smoker's carelessness or the like.

2. Description of the Related Art

In order to prevent the burning part of a cigarette from spreading a fire, for example, when the cigarette is dropped by the smoker by accident due to carelessness onto a floor or the like, there have been proposed a cigarette imparted with a self-extinguishing property by providing its wrapper paper with a cellulose paper band having a width of 2 to 20 mm (Jpn. Pat. Appln. KOKAI Publication No. 63-85200) and a cigarette provided with a band coated with a flame-retarding substance on the tobacco wrapper paper (see Jpn. Pat. Appln. KOKAI Publication No. 7-300795). Further, a tobacco wrapper paper to which an incombustible material is attached is conventionally known. These techniques are based on the findings that when high and low combustible regions are made in a tobacco wrapper paper sheet, ordinary smoking can be conducted in the highly combustible region, whereas the cigarette extinguishes by itself when there is a substance in contact with the cigarette in the low combustible region.

In the meantime, it is conventionally known well that if the burning rate of a cigarette is lowered in order to reduce the amount of sidestream smoke per unit time, a cigarette that easily extinguishes by itself can be provided. An example of such a cigarette is the one using wrapper paper having a small amount of filler blended thereinto as an inside wrapper and a conventional wrapper paper as an outside wrapper paper sheet, to wrap shredded tobacco. (See the specification of Japanese Patent No. 2572488.)

However, in the case where wrapper paper having an incombustible region is used, a highly combustible portion and a low combustible portion are created. Due to this, some unnatural suction may become necessary during smoking, and the taste of the smoke may vary. Further, the method in which a self-extinguishing property (low fire-spreading property) is imparted by reducing the burning rate is conventionally realized by reducing the air permeability of the wrapper paper. Thus, the ventilation effect of the wrapper paper is deteriorated, thereby causing a change in the smoking taste. Therefore, ordinary smokers may feel odd while smoking. In order to prevent the adverse effect of lowered ventilation caused by the reduction of the air permeability of the wrapper paper, a method of is also known, in which a filter is attached to a cigarette and perforations are made in its filter tipping paper as a compensation for the ventilation. However, perforation on filter tipping paper is a costly process.

On the other hand, Jpn Pat. Appln. KOKAI Publication No. 60-59199 discloses a technique of packaging a tobacco column with two packaging members each having a predetermined range of BMI (burn rate index) value, in order to provide a smoking article having a low tendency. Of the two packaging members, the inner member has an air permeability of low as 1 CORESTA unit. At any event, Jpn Pat. Appln. KOKAI Publication No. 60-59199 does not discloses or even suggest that the heat conductivity of wrapper paper is correlated to the fire spreading property of cigarette.

An object of the present invention is to provide a low fire-spreading cigarette having the same burning rate in its axial direction as that of a conventional cigarette.

BRIEF SUMMARY OF THE INVENTION

The present inventors have carried out extensive studies in an attempt to achieve the above-described object and found that a low fire-spreading cigarette that has the same burning rate as that of the conventional cigarette, but is low in fire-spreading property, different from the prior art cigarette, by wrapping a tobacco filler material with two wrapper paper sheets, that is, one that makes the lit part to go out by itself, more specifically, a wrapper paper sheet (inside wrapper) having a heat conductivity of 0.5 $W \cdot K^{-1} \cdot m^{-1}$ or more is used to directly wrap the tobacco filler material and further a high burnable wrapper paper sheet among those conventionally known paper sheets, more specifically, a wrapper paper sheet (outside wrapper) having a heat conductivity of less than 0.5 $W \cdot K^{-1} \cdot m^{-1}$ is used to further wrap the wrapped tobacco filler material. The present invention is based on this finding.

Thus, according to the present invention, there is provided a low fire-spreading cigarette comprising a tobacco section including a columnar tobacco filler material, an inside wrapper paper sheer wrapping the outer circumferential surface of the columnar tobacco filler material and an outside wrapper paper sheet wrapping the outer circumferential surface of the inside wrapper, wherein the inside wrapper paper sheet has a heat conductivity of 0.5 $W \cdot K^{-1} \cdot m^{-1}$ or more and the outside wrapper paper sheet has a heat conductivity of less than 0.5 $W \cdot K^{-1} \cdot m^{-1}$.

In a cigarette according to the present invention, the tobacco section can exhibit a weight burning rate of 55 mg/min or more and a linear static burn rate of 5.0 mm/min or more.

In the present invention, the inside wrapper can contain 0 to 0.5% by weight of a loading or filler material, and should preferably have an air permeability of 5 to 30 CORESTA units.

DETAILED DESCRIPTION OF THE INVENTION

The present invention will now de described in more detail.

A cigarette according to the present invention includes a tobacco section having a columnar tobacco filler material wrapped with two wrapper paper sheets (inside wrapper and outside wrapper paper sheets). In other words, in the cigarette of the present invention, the tobacco filler material is wrapped by a wrapping material comprising an inside wrapper paper sheet and an outside wrapper paper sheet each of which has a specified heat conductivity. The heat conductivity of a wrapper paper sheet can be adjusted by increasing/decreasing the amounts of a loading or filler material (usually such as calcium carbonate and magnesium hydroxide) added to a base material of pulp, and the pulp itself, or controlling the paper layer structure.

The inside wrapper paper sheet of the present invention is characterized by its high heat conductivity (0.5 $W \cdot K^{-1} \cdot m^{-1}$ or more). More specifically, the inside wrapper paper sheet is made by adding no or, if any, an extremely small amount (0.5% by weight or less) of loading material (usually, calcium carbonate or magnesium hydroxide, for example, is used) to a base wrapper paper sheet made of pulp such as flax pulp or wood pulp. It is preferable that a burn control agent such as a citrate salt should not be added. In the present invention, the inside wrapper paper sheet can usually have a heat conductivity of up to 0.6 $W \cdot K^{-1} \cdot m^{-1}$. It is preferable that the inside wrapper paper sheet should have a heat conductivity in a range of 0.52 to 0.56 $W \cdot K^{-1} \cdot m^{-1}$. The basis weight of the inside wrapper paper sheet is not particularly limited, but usually, it should preferably be about 15 to 35 $g/m^2$. In the present invention, the air permeability of the inside wrapper paper sheet is not particularly limited, but it should be high depending on a combination with the outside wrapper paper sheet. The air permeability of the inside wrapper paper sheet should preferably be 5 to 30 CORESTA units and more preferably, 10 to 30 CORESTA units. If the permeability of the inside wrapper paper sheet is high, the amount of air introduced from the sheet into the cigarette is increased, thereby further diluting the mainstream smoke and reducing the amount of carbon monoxide by the corresponding amount. Further, if the permeability of the inside wrapper paper sheet is high, the amount of air introduced from the sheet into the cigarette is increased, thereby making it possible to reduce the number of ventilation holes perforated in a tip paper.

The outside wrapper paper sheet has a heat conductivity of less than 0.5 $W \cdot K^{-1} \cdot m^{-1}$. The outside wrapper paper sheet is made of a pulp such as flax pulp or wood pulp as a base material, and it is preferable that the sheet should contain 1% to 5% by weight of a burn control agent such as citric acid or its salt (for example, a sodium salt or potassium salt). In the present invention, the inside wrapper paper sheet can usually have a heat conductivity of 0.25 $W \cdot K^{-1} \cdot m^{-1}$ or more. It is preferable that the outside wrapper paper sheet should have a heat conductivity in a range of 0.29 to 0.45 $W \cdot K^{-1} \cdot m^{-1}$, more preferably a heat conductivity in a range of 0.29 to 0.35 $W \cdot K^{-1} \cdot m^{-1}$. Generally, the basis weight of the outside wrapper paper sheet is about 20 to 70 $g/m^2$, and the air permeability thereof should preferably be about 10 to 100 CORESTA units. It is preferable that the outside wrapper paper sheet contain a loading material such as calcium carbonate or magnesium hydroxide in an amount of 10% by weight to 60% by weight.

In the present invention, the tobacco filler material is the one such as shredded tobacco, which is usually used for a cigarette, and the filling density is not different from that of conventional cigarettes.

The cigarette of the present invention may have a conventional filter amounted to one end of the tobacco section.

The cigarette of the present invention can be clearly distinguished from that of the prior art technique in terms of the heat conductivity of the inside wrapper paper sheet that directly wraps the tobacco filler material. It is another feature of the present invention that the air permeability of the inside wrapper paper sheet does not have to be particularly limited. More specifically, by increasing the air permeability of the inside wrapper paper sheet from 5 CORESTA to about 30 CORESTA (note that the CORESTA air permeability is defined by International Standard ISO 2965), the prior art problem that the ventilation through the wrapper material of the conventional double-wrapper paper cigarettes can be solved. Further, it is still another feature of the present invention that a high burnable wrapper paper is used for the outside wrapper paper sheet, by which the combustion of the low burnable inside wrapper paper sheet can be effectively supported.

In the cigarette of the present invention that comprises a tobacco section of the above-described structure, the tobacco section can exhibit a weight burn rate of 55 mg/min or more and a linear static burn rate of 5.0 mm/min.

Examples of the present invention will now be described.

Cigarettes A to L of the specifications presented in Table 1 below were manufactured by an ordinary method. Cigarettes A to J are comparative examples, and cigarettes K to L are products of the present invention. They are difference from each other only in the specifications and structures of the wrapper paper sheets. The basis weight, the amount (% by weight) of a loading material (calcium carbonate), the amount (% by weight) of the burn control agent (potassium citrate), the heat conductivity and the air permeability of each wrapper paper sheet are indicated in Table 1. The heat conductivity was measured by the non-steady planar heat source method.

In each of the cigarettes, the shredded tobacco was an ordinary commercially available American blend (filing density of 218 $mg \cdot cm^{-3}$), with the circumference of the cigarette being 24.8 mm and the length of the cigarette being 84 mm. With regard to these cigarettes, the weight burn rate, linear burn rate and ignition rate were measured. The weight burn rate and linear burn rate were measured under a flat calm, with the cigarette disposed laterally. The ignition rates presented in Table 2 are results of measurements carried out by the mock-up ignition method reported by the United States National Institute of Standard Technique (NIST) (see Mock-Up Ignition Method and Cigarette Extinction Test Method; Ohelemiller, T. J., Villa, K. M., Braun, E., Eberhard, K. R., Harris, Jr., R. H. Lawson, J. R., and Gann. R. G., "Test Methods for Quantifying the Propensity of Cigarettes to Ignite Soft Furnishings", NIST Special Publication 851). More specifically, the "# duck material" shown in Table 2 indicates results of the test conducted by the Mock-Up Ignition Method, in which 48 cigarettes that have been subjected to static burn of 15 mm length with the cigarette being let to stand up are laid down calmly on #6 duck material, and then the percentage of those cigarettes, which have been able to ignite the cotton cloth when they are left as they burn, is obtained. Further, in Table 2, the "filter paper" indicates the results of measurement by the Cigarette Extinction Test Method, in which 16 cigarettes that have been naturally burned for 15 mm while being let to stand up are laid down calmly on 10-stack Whatman No. 2 filter paper sheets, and then the percentage of those cigarettes, which have burned to the end without being extinguished in the middle when they are left as they burn, is obtained.

TABLE 1

| Cigarette | | Specification of Wrapper Paper Sheet | | | | | |
|---|---|---|---|---|---|---|---|
| | | Construction of Wrapper | Basis Weight ($g/m^2$) | Loading Material (%) | Burn Control Agent (%) | Heat Conduct. (W/K · m) | Air Permeability (CORESTA unit) |
| Comp. Examples | A | Single Wrap (Wrapper A) | 32 | 45 | 5 | 0.32 | 88 |
| | B | Single Wrap (Wrapper B) | 31 | 45 | 3 | 0.33 | 88 |
| | C | Single Wrap (Wrapper C) | 25 | 25 | 1 | 0.38 | 20 |
| | D | Single Wrap (Wrapper D) | 21 | 32 | 1 | 0.41 | 12 |
| | E | Single Wrap (Wrapper E) | 19 | 4 | 1 | 0.46 | 35 |
| | F | Single Wrap (Wrapper F) | 15 | 0 | 0 | 0.56 | 6 |
| | G | Single Wrap (Wrapper G) | 15 | 0 | 0 | 0.50 | 15 |
| Comp. Examples | H | Double Wrap: Wrapper C (Outside) Wrapper C (Inside) | — | — | — | — | — |
| | I | Double Wrap: Wrapper D (Outside) Wrapper D (Inside) | — | — | — | — | — |
| | J | Double Wrap: Wrapper B (Outside) Wrapper E (Inside) | — | — | — | — | — |
| Present Invention | K | Double Wrap: Wrapper B (Outside) Wrapper G (Inside) | — | — | — | — | — |
| | L | Double Wrap: Wrapper A (Outside) Wrapper F (Inside) | — | — | — | — | — |

TABLE 2

| Cigarette | | Cigarette Properties | | | |
|---|---|---|---|---|---|
| | | Weight | Linear Static | Ignition Rate (%) | |
| | | Burn Rate (mg/min) | Burn Rate (mm/min) | #6 Duck Material | Filter Paper |
| Comp. Example | A | 61.2 | 5.73 | 100 | 100 |
| | B | 59.3 | 5.55 | 100 | 100 |
| | C | 56.9 | 5.33 | 100 | 100 |
| | D | 53.2 | 4.98 | 100 | 100 |
| | E | 35.7 | 3.34 | 100 | 100 |
| | F | Natural Extinction | — | — | — |
| | G | Natural Extinction | — | — | — |
| | H | 59.7 | 5.59 | 100 | 100 |
| | I | 53.7 | 5.03 | 90 | 100 |
| | J | 59.2 | 5.55 | 100 | 100 |
| Present Invention | K | 59.4 | 5.56 | 13 | 0 |
| | L | 59.1 | 5.54 | 8 | 0 |

As is clear from the results shown in Table 2, the cigarette of the present invention has a very low ignition rate while maintaining a weight burn rate similar to that of the conventional products.

As described above, according to the present invention, there is provided a low fire-spreading cigarette that has the same burning rate in its axial direction as that of conventional ones. Since the cigarette of the present invention has the same burn rate in its axial direction as that of conventional cigarettes, its smoking taste does not differs from that of the conventional one.

What is claimed is:

1. A low fire-spreading cigarette comprising:

a tobacco section including a columnar tobacco filler material, an inside wrapper paper sheet wrapping an outer circumferential surface of the columnar tobacco filler material, and an outside wrapper paper sheet wrapping an outer circumferential surface of the inside wrapper paper sheet, wherein the inside wrapper paper sheet has a heat conductivity of 0.52 to 0.56 $W \cdot K^{-1} \cdot m^{-1}$ and the outside wrapper paper sheet has a heat conductivity of less than 0.5 $W \cdot K^{-1} \cdot m^{-1}$, and the inside wrapper paper sheet contains 0 to 0.5% by weight of a loading material.

2. The cigarette according to claim 1, wherein the tobacco section exhibits a weight burn rate of 55 mg/mm or more, or a linear static burn rate of 5.0 mm/mm or more.

3. The cigarette according to claim 1, wherein the inside wrapper has an air permeability of 5 to 30 CORESTA units.

4. The cigarette according to claim 1, wherein the loading material is selected from the group consisting of calcium carbonate and magnesium hydroxide.

5. The cigarette according to claim 1, wherein the inside wrapper paper sheet has a basis weight of 15 to 35 $g/m^2$.

6. The cigarette according to claim 1, wherein the inside wrapper paper sheet is free of a burn control agent.

7. The cigarette according to claim 1, wherein the outside wrapper paper sheet contains 10 to 60% by weight of a loading material.

8. The cigarette according to claim 1, wherein the outside wrapper paper sheet contains 1 to 5% by weight of a burn control agent.

9. The cigarette according to claim 8, wherein the burn control agent is selected from the group consisting of citric acid and a salt thereof.

10. The cigarette according to claim 1, wherein the outside wrapper paper sheet has an air permeability of 10 to 100 CORESTA units.

11. The cigarette according to claim 1, wherein the outside wrapper paper sheet has a basis weight of 20 to 70 $g/m^2$.

12. A low fire-spreading cigarette comprising:

a tobacco section including a columnar tobacco filler material;

an inside wrapper paper sheet wrapping an outer circumferential surface of the columnar tobacco filler material, the inside wrapper paper sheet has a heat conductivity of 0.52 to 0.56 $W \cdot K^{-1} \cdot m^{-1}$, and containing 0 to 0.5% by weight of a loading material; and an outside wrapper paper sheet wrapping an outer circumferential surface of the inside wrapper paper sheet, the outside wrapper paper sheet having a heat conductivity of less than 0.5 $W \cdot K^{-1} \cdot m^{-1}$, wherein the tobacco section exhibits a weight burn rate of 55 mg/min or more or a linear static burn rate of 5.0 mm/mm or more.

13. The cigarette according to claim 12, wherein the loading material is selected from the group consisting of calcium carbonate and magnesium hydroxide.

14. The cigarette according to claim 12, wherein the inside wrapper paper sheet has a basis of weight of 15 to 35 $g/m^2$.

15. The cigarette according to claim 12, wherein the inside wrapper paper sheet is free of a burn control agent.

16. The cigarette according to claim 12, wherein the outside wrapper paper sheet contains 10 to 60% by weight of a loading material.

17. The cigarette according to claim 12, wherein the outside wrapper paper sheet contains 1 to 5% by weight of a burn control agent.

18. The cigarette according to claim 17, wherein the burn control agent is selected from the group consisting of citric acid and a salt thereof.

* * * * *